US006018924A

United States Patent [19]

Tamlyn

[11] Patent Number: 6,018,924

[45] Date of Patent: Feb. 1, 2000

[54] ADJUSTABLE REVEAL STRIP AND RELATED METHOD OF CONSTRUCTION

[76] Inventor: John Thomas Tamlyn, 10406 Cash Rd., Stafford, Tex. 77477-4492

[21] Appl. No.: 08/915,979

[22] Filed: Aug. 21, 1997

[51] Int. Cl.[7] ..... E04B 2/00

[52] U.S. Cl. ..... 52/716.8; 52/718.01; 52/717.05; 52/287.1; 52/311.2; 52/312; 52/462; 52/470; 52/800.12; 52/745.19

[58] Field of Search ..... 52/716.1, 716.2, 52/716.8, 718.01, 718.04, 718.05, 718.02, 717.05, 287.1, 288.1, 311.1, 311.2, 312, 254, 255, 256, 257, 212, 460, 461, 462, 463, 464, 470, 471, 770, 771, 764, 772, 781.3, 712, 519, 547, 521, 543, 549, 556, 800.12, 364, 365, 371, 376, 717.06, 733.4, 745.19

[56] References Cited

U.S. PATENT DOCUMENTS

| | | | |
|---|---|---|---|
| 2,308,129 | 1/1943 | Tummins | 52/547 |
| 2,348,658 | 5/1944 | Slaughter | 52/717.05 |
| 2,867,013 | 1/1959 | Haag et al. | 52/288.1 |
| 3,304,679 | 2/1967 | Benkin | 52/312 |
| 3,331,176 | 7/1967 | Washam | 52/371 |
| 3,374,590 | 3/1968 | Kessler | 52/464 X |
| 3,445,972 | 5/1969 | Carr | 52/470 X |
| 3,462,900 | 8/1969 | Morrissey | 52/312 |
| 3,550,340 | 12/1970 | Klein | 52/312 |
| 3,568,391 | 3/1971 | Conway | 52/364 X |
| 3,672,108 | 6/1972 | Conway | 52/367 |
| 4,319,439 | 3/1982 | Gussow | 52/288.1 |
| 4,545,162 | 10/1985 | Attaway | 52/255 |
| 4,622,791 | 11/1986 | Cook et al. | 52/241 |
| 4,785,601 | 11/1988 | Tupman | 52/364 |
| 5,423,154 | 6/1995 | Maylon et al. | 52/364 X |
| 5,531,050 | 7/1996 | Stibolt et al. | 52/254 |
| 5,564,245 | 10/1996 | Rademacher | 52/547 |

FOREIGN PATENT DOCUMENTS

| | | | |
|---|---|---|---|
| 1042708 | 11/1953 | France | 52/489.1 |
| 2012478 | 10/1971 | Germany | 52/288.1 |
| 2237040 | 4/1991 | United Kingdom | 52/311.1 |

*Primary Examiner*—Laura A. Callo
*Attorney, Agent, or Firm*—Gunn & Associates, P.C.

[57] ABSTRACT

An adjustable reveal is set forth for use in wall construction. In a framed wall, a first and second panel are positioned on the wall to define parallel edges. The spacing between the edges is adjusted so that a sight area is seen between them. A back panel parallel to the two edges is positioned adjacent to the frame and supports an integrally made extending J-shaped slot which is adapted to clasp around and along the edge on one of said panels. A movable J-shaped slot encloses the other edge, thereby defining the visible site area between the two edges. The back panel is integral with one of the J-shaped slots, and the other is preferably positioned in front of the back panel.

20 Claims, 1 Drawing Sheet

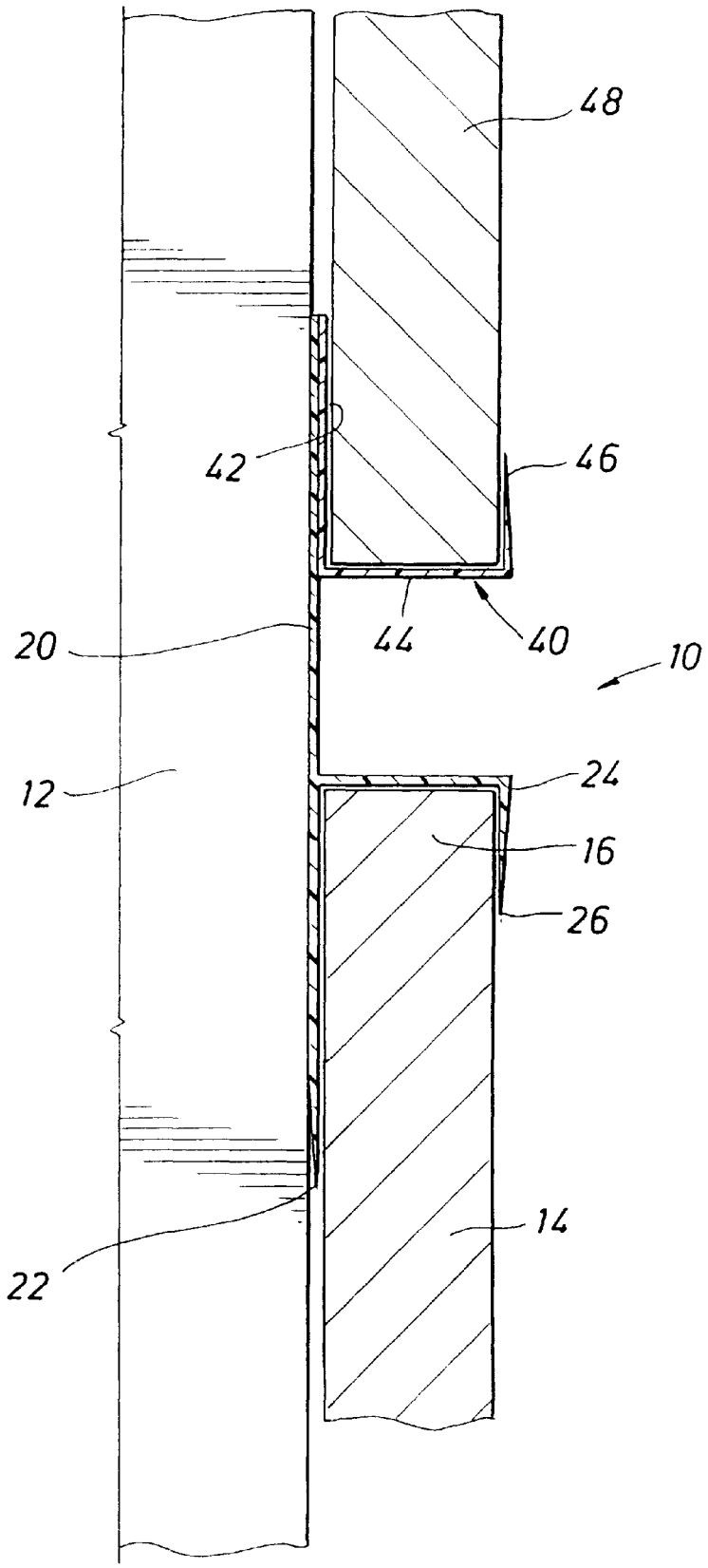
48
42
46
20
44
40
10
12
24
16
26
14
22

ADJUSTABLE REVEAL STRIP AND RELATED METHOD OF CONSTRUCTION

BACKGROUND OF THE DISCLOSURE

This disclosure is directed to an adjustable reveal which is used in the external surface construction of framed buildings, typically residences, in which the external wall covering is provided with controlled decorative strips between vertical panels such as shingles or planks. More specifically, reference is made to a typical and common residential construction in which spaced decorative strips are installed to separate areas or regions of the vertical siding panels exemplified by shingles or planking on the exterior. Some buildings are constructed with the vertical planking on the exterior. Others use a horizontal planking. Consider an example in which regular planking which is between six inches wide and twelve inches wide is installed horizontally. It is overlapped so that it will shed water. Consider an alternative in which shingles are installed. Typical shingles might be as much as 16–30 inches in height and have a width of 20–40 inches. They are installed in rows preceding from the bottom up, again provided with overlap to shed water.

It is customary that the vertical panels such as planking or shingles will be installed over a water barrier such as sheet of film or felt which is nailed to the unfinished exterior wall prior to placing the panels (i.e., planks) on the building. In many instances, the selected vertical panels are installed with controlled spaces or gaps. This is sometimes done to make a change in color or make a change in finish material. In the latter instance, consider an example of a residential construction featuring 10 inch wide planks which are applied below sheet material (having a size of 4 feet by 8 feet), applied with the 4 foot dimension above a divider strip. By appropriate color application, a wainscoted appearance can be obtained. A dark lower finish can be applied below the border and a lighter upper finish there above provides an attractive contrast. In this example the border decorative strip between the two different types of material (meaning planking below and sheet above sets the regions apart). In some instances, it might be desirable to apply four darker horizontal divider strips between shingle rows (width of 2 feet) so that approximately 8 feet of vertical wall coverage is attractively placed on the building. Such residential construction has a variety of appearances. Taking into account the visible part of the foundation and border height shrubbery on the ground, it is possible to enhance the attractive exterior finish on a residence with two or three of the strips of the present disclosure.

The strip of this disclosure is especially attractive in that it is adjustable in width and can accommodate different finishes above and below. Moreover, whether painted uniformly or differently at different heights, it enables a change in texture or geometry to be accomplished easily with or without a change in color. With both texture and color change, the adjustable reveal strip of the present disclosure enables painting of specifically installed planking selected and the trim. Moreover it enables an adjustable width trim to be attached between the installed planks or shingles. It does not require that the construction crew actually stock any particular size of trim. Because it can be adjusted in width, changes can be made in the field. Slight misadjustments in the height of the trim or finish materials on a residence can be accommodated. It can also accommodate the variations in spacing that are encountered when lapping adjacent layers. For instance, while planking for exterior covering might have a nominal width of 6 inches, 8 inches or 10 inches, a variation in the overlap of one quarter inch can make a notable change in spacing on the top of 20 planks. By using the adjustable reveal strip of the present disclosure, accommodations can be made for variations in vertical overlap.

The adjustable reveal of the present disclosure finds application both in horizontal trim strips but vertical installations are also permitted. This disclosure sets forth such an adaptive strip arrangement. By positioning the adjustable reveal in a vertical direction, variations in wall length can also be accommodated. Consider for instance a residential construction which is being externally covered with sheets which are 4 feet in width. This strip affixed at the edge of a window casement can be installed so that there is a nice decorative break along the two edges of the vertical window frame. The regions above and below the window can then be trimmed and finished in the same material or a different material depending on cosmetic aspects. In general terms, this avoids the necessity of stocking several widths of trim boards. Even with wall covering material which is precisely cut, the size accommodations are difficult to actually implement at the time attaching the trim strips. With the adjustable reveal strip of the present disclosure, significant adjustments can be made. The visible trim can be as narrow as about ½ inch but it can be increased up to about two inches in width.

In one major aspect, the adjustable width benefit obtained from the variable width reveal strip of the present disclosure also enhances installation of different materials. It is not uncommon to erect a wood structural frame, attach a layer of insulation material over that, then attach wood shingles and planking on the exterior. Another variation might involve the installation of fiber-cement siding. Products such as the Hardplank® (a product of James Hardie Building Products) have met with great success. Problems however exists in that the fiber-cement products cannot contact uncoated aluminum. This sets up an undesired chemical reaction. The galvanic reaction derives from the relative chemical activity of the aluminum contacted against the finish components. Aluminum fasteners are not acceptable in conjunction with the fiber-cement product just mentioned. Accordingly, this trim system must be handled in a different way through the use of the adjustable reveal strip of the present disclosure. This disclosed strip permits the applicator to install the fiber-cement products and overcome the problem of contact with aluminum. The fiber-cement product is contacted with the vinyl strip of the present disclosure which is able to border and contact the fiber-cement products without aluminum or other metals causing galvanic reactions.

The present disclosure is summarized as an adjustable width trim which is formed of two strips. One is relatively wide, typically in the range of 2–4 inches and is constructed with an inverted J shaped slot. This slot serves as a cap to extend over the top edge of a lower course or row of wall mounted shingles or planking. The width of the slot conforms to the width of the top edge. The width terminates at an over hanging exposed lip which reaches over or locks in front of the installed planks or panels. A back plate extends above the inverted J slot to enable a visible exposed middle portion. The back plate is visible by an amount determined by the subsequent attachment of a second J slot. The first is made integral with the back plate while the second J slot is made separately and is moved up or down to adjust the visible area.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawing illustrates only a typical embodiment of this invention and is therefore not to be considered limiting of its scope, for the invention may add to other equally effective embodiments.

The only drawing with the present disclosure illustrates in sectional view the adjustable reveal strip installed on the exterior of a wall construction for providing an adjustable width decorative trim strip.

DETAILED DESCRIPTION OF PREFERRED EMBODIMENTS

Attention is directed to the only drawing where the numeral 10 identifies the adjustable reveal strip of the present disclosure. This description will begin by providing the context of its installation. It is typically installed on the exposed side of an exterior wall. Assume for purposes of description that the exterior wall is the fabricated framed wall of a residential construction. Assume in this regard that it will be covered with two different types of finish, having differences in color, differences in cut, or differences in material. The covering variety is dependent in part on the cosmetic aspects; in part, the adjustable reveal strip of the present disclosure surprisingly enhances the adaptability of wall finishes. More specifically, and beginning with the structure illustrated, it will he observed to incorporate a frame member 12 which is constructed for the wall and which is typically a vertical 2×4 frame member although the precise size can readily vary. Frame members are installed in the wall during fabrication. Between frame members, insulation such as Styrofoam or insulation bats can be installed. Alternately, the spaces can be left between the frame members. The frame member 12 may be constructed with an external sheet of paper, felt or other material to provide vapor exclusion. That has been omitted because it is relatively thin and difficult to represent in the sectional view of the present disclosure. The sectional cut through the wall shows a lower exterior wall covering member 14 which is attached on the wall. The covering member 14 can be horizontal planking which is overlapped, shingles which overlap or it can be a planar sheet standing to a specified height. The lower plank 14 can also be made of particle board, plywood, fiber-cement material previously mentioned or other wall covering. Whether a single sheet or overlapped planking or shingles, it is placed on the wall in the customary fashion, typically nailing. Where horizontal planks are used, they are typically overlapped so that there will be a small angular canting of the installed planks. The angle is sufficiently small that it is not important to the pictorial representation of the lower plank 14. The thickness of the lower plank is an important factor in cooperation with the present apparatus. It terminates at a top or upper portion 16 which might be 5/16", 7/16", ½", ⅝ etc. depending on the edge 16 thickness. Again the thickness at the top edge 16 is noted and that is preferably kept in the range of 1 quarter to ½ inch. That thickness defines one measure of the adjustable reveal of the present disclosure.

The strip 10 is constructed with a full height back plate 20 which is formed to a thickness of about 3–8 mills. The thickness is sufficient that it has enough strength when formed of polyvinyl or perhaps polyethylene extruded to maintain structural integrity. It is extruded to a width of about 2 inches, ranging up to about 4 inches. The width is uniform along the length, and the thickness is also uniform. Some reduction in thickness is permitted at the lower edge 22 to simply reduce the amount of material required in the fabrication of the strip. It is integrally constructed with an inverted J slot 24 which extends at right angles to a dimension enabling the inverted slot to fit over the top marginal edge 16 of the lower panel member 14. If the dimension is one quarter of an inch, the J slot is slightly wider than one quarter inch. The width is adequate to reach over an exposed front face terminating at a lower edge 26. The front face (extending down to the edge 26) has a width of somewhere between ¼ and ½ inch. The width is relatively uniform. The edge 26 can be tapered, again to reduce the amount of material. It is not necessary to construct the structure as shown in the drawing with a sharp edge 26. Rather, it is desirable to reduce the amount of plastic material in the extruded strip 10. With wood panel or planking 14, it is generally desirable to maintain the overlap 26 so that water does not splash over the top marginal edge of the planking 14. The fiber-cement product just mentioned is essentially water resistant and will not absorb any water. But some composite materials may be vulnerable along the marginal edge 16. For instance, while they may have an external skin which is water repellent, the edge may permit water to enter behind the skin and thereby prompt swelling and damage. To reject that water, the J shaped slot is inverted and formed integrally with the back plate 20. The back plate 20 is held in position without nailing. Typically, the strip is clamped in place by the wall covering nailed to the vertical frame members. Normally, the shingles or panels are nailed after leveling to assure a proper cosmetic appearance. Moreover, after snugly fitting the bottom plank 14 in the J shaped slot, thereby assuring that minor misalignments are accommodated, the plank 14 is nailed to the frame members. The strip 10 is preferably formed with substantial length, being typically supplied in long lengths of many feet. It is easily cut transversely to match up with the length of a building wall. By using long lengths, seams in the strip 10 can be avoided.

The strip 10 is approximately equal in length to the wall and is clamped in placed on the wall. The wall is normally assembled with the planking applied from bottom to top. So the planking 14 is located first, and the strip 10 is then placed along the top edge of it. While it may be necessary to nail the panel or plank 14 in place, sufficient gap is left between the plank 14 and the vertical frame member 12 so that the back plate 20 can be installed simply by forcing the edge 22 behind the plank 14. At that stage of construction, no problem arises with this insertion. After insertion, the strip 10 is then nailed to the frame members 12 when the plank 14 is nailed in place. As a generalization, the light weight strip 10 is not nailed but rather it is held in place by the assembled wall components.

The next step in fabrication is to install the J-shaped strip 40 parallel to and at an adjustable position in front of the back plate so that proper sight areas are defined. The J-shaped slotted member 40 is a separable part constructed with a back wall 42, a transverse bottom 44 and a front facing edge 46. They are arranged at right angles. The depth of the throat is sized so that it will fit along the bottom edge of the upper sheet panel or plank 48 which is similar to the lower plank 14 but they differ primarily in location; the upper and lower planks are sized so that they are grasped in the J-shaped slots on the marginal edges of the panels or planks 14 and 48. At the time of installation, the plank 48 is pushed into the slot and then nailed to the frame member 12. In this particular instance, the J-shaped slot member 40 is clamped in position by nailing, the panel or plank member 48 to the wall. Because of a snug fit and relatively light weight construction, the strip 40 is easily held in the desired position. One alternative installation however utilizes the same structure installed in a different sequence. Rather, the strip 40 is held up against the wall and is nailed or stapled in place. For that installation, the two strips become one. When attached, the two strips are relatively light so that only a few nails or staples are required to join them together. The most common attachment is by nailing the exterior panels, not the strip 40. The vertical position of the strip 40 is adjusted to the required spacing.

The strip 40 is formed of the same thickness of material as the strip below. It is formed with a width defined by the edge thickness of the panel or plank member 48. Specifically the depth of the throat is sufficient to grasp the lower edge of the exterior wall member 48. If the exterior member is sheet plywood, fiber-board, particle board, or the fiber-cement product just mentioned, it typically is provided in widths of up to about ½ inch. It is installed in that way so that there is a fairly tight or snug grip, thereby permitting the upper panel 48 to be inserted.

An important aspect of the present system is the visual portion of the back plate 20. That is the sight area located between the two J slots. That can be varied by adjustment. Adjustment upwardly or downwardly accommodates and thereby changes the sight area. When changed, the sight area forms a decorative strip, horizontal in the present instance, that can be individually treated, colored, painted or otherwise finished. The present apparatus is formed of extruded elongate polyvinyl or polyethylene. When made to the thicknesses suggested, is sufficiently strong that it provides a decorative function and yet also caps the marginal edges of the planks. This assured that the sight area including the protruding edges 26 and 46 can be uniquely painted. As an example the lower plank can be finished with a black paint, gray can be applied to the ad justable reveal strip 10, and the top plank 48 can be colored white. Variations in color are readily permitted. The strip defines a recessed area which becomes a visual contrast by virtue of a shadow in the recessed area. This shadow line, even with the same color paint, can readily define or set off the area between two parallel regions on the vertical wall. Viewed by any observer, the recessed strip, whether vertical or horizontal, serves as a divider or accent Strip in terms of cosmetics. Better than that, it is an aid to be installed between small or larger exterior wall portions. The shadow area, coupled with panel color, panel surface texture, and shingling pattern(s), define attractive areas. The exterior wall panel areas are accented in this manner.

It is not mandated that the strip 40 have the same length as the strip 10. Rather, they are conveniently made to the same length. In general terms, they are attached jointly and used jointly with the adjustments in width as noted, and they are provided with the same finish or color.

Going now to another aspect of this, assume that the strip 10 is installed along a single path at an appropriate height on the full length of a wall. In another application it can be installed with vertical strips, perhaps 4 feet apart. An example was mentioned earlier in which it is installed above and below a window frame so that it lines up with the edges of the window flame. With this particular embodiment, the installation can be varied between horizontal and vertical with one only installed or the alternative of multiple strips 10 can be implemented. In all instances, variety is permitted. For a given installation, the sight area between the two J-shaped slots can be varied. It can be substantially closed; it can be opened to the maximum which is permitted by the construction of the strip and in particular based on the height of the back plate 20.

While the forgoing is directed to the preferred embodiment, the scope is determined by the claims which follow.

I claim:

1. An apparatus for assembling a wall construction having a frame and a first panel attached to the frame and defining a first extreme outer surface of the first panel and a second panel attached to the frame and defining a second extreme outer surface of the second panel, the apparatus comprising:

(a) a contiguously planar, single layer back plate for fastening to the frame behind said first and second panels, the back plate defining an upper edge that is adapted to be substantially flush with the frame;

(b) a first slot for clasping along and reaching over said first panel, the first slot including a downwardly extending edge that is adapted to extend over the first extreme outer surface of the first panel; and (c) a second slot for clasping along and reaching over said second panel, the second slot including an upwardly extending edge that is adapted to extend over the second extreme outer surface of the second panel;

(d) wherein (i) said first and second slots are position in front of said back plate, (ii) the position of said second slot is adjustable with respect to said first slot, and the second slot is adapted to be supported solely by the second panel without attachment to the frame, and (iii) said first and second slots are parallel and separated to define a sight visible area of said back plate between said first and second slots.

2. The apparatus of claim 1 wherein said back plate has a specified width and is formed of a material with sufficient strength and rigidity to hold said back plate against the frame of said wall.

3. The apparatus of claim 1 wherein said back plate is integrally formed with said first slot so that said first slot is defined by three walls at right angles and said back plate comprises one of said three walls.

4. The apparatus of claim 3 wherein said first slot terminates at an edge and said edge is located forward of said back plate and is deployed by spacing therefrom to reach over said first panel.

5. The apparatus of claim 3 wherein said back plate and first slot define two walls of said slot which are parallel and equal in length.

6. The apparatus of claim 5 wherein said first slot has a width sized to accept and fit around an edge of said first panel.

7. The apparatus of claim 6 wherein said sight visible area includes the portion of said back plate located between said first and second slots.

8. The apparatus of claim 7 wherein said second slot is movable to a parallel position with the respect to said first slot and is deployed at an adjustable spacing therewith and thereby defines an adjustable sight visible area.

9. The apparatus of claim 8 wherein said second slot is sized to fit in front of and at the top of said back plate.

10. The apparatus of claim 8 wherein said back plate and said first slot are formed of a resilient plastic material having a thickness of more than about three mils and are sufficiently thick to maintain strength when installed.

11. The apparatus for claim 1 wherein said first and second panels are positioned with edges adjacent and horizontal along the wall and said first and second slots have a length to receive the edges of said first and second panels.

12. The apparatus of claim 1 wherein said first and second panels are deployed to define vertical parallel edges and said back plate is adapted to extend therebetween and is adapted to extend to the top of the wall.

13. The apparatus of claim 1 wherein said back plate and said first and second slots are formed of an extruded plastic material and are therefore not reactive when in contact with said first and said second panels made of fiber-cement.

14. The apparatus of claim 1 wherein said back plate and said first and second slots are formed of material suitable for painting.

15. The apparatus of claim 1 wherein said back plate is adapted to be fastened to said frame by clamping action of said first and said second panels.

16. A method of fabricating a framed wall having an exterior with a cover thereon and the cover defining a substantially flat outer surface, the method comprising the steps of:

(a) erecting the framed wall with a first panel and first panel edge there along;

(b) positioning a back plate behind said first panel and parallel to the frame of said wall;

(c) providing a tapered edge engaging lengthwise slot on said back plate wherein said slot extends over said first panel edge and over the outer surface;

(d) positioning a second and parallel panel spaced from said first panel wherein said second panel defines a second panel edge which is parallel to the edge of said first panel;

(e) adjustably positioning from said slot a second tapered edge engaging slot along said second panel edge and over the outer surface; and (f) fastening said second slot with respect to said first slot to define a sight area of adjustable width between said first panel and second panel, wherein the step of fastening by fastening the second panel to the frame without fastening the second slot to the frame.

17. The method of claim 16 including the step of adjusting the spacing between said panel edges so that the sight area is adjusted in accordance therewith.

18. The method of claim 16 including the step of attaching the back plate to said frame with fasteners therethrough.

19. An adjustable reveal strip for a wall construction to be mounted on a plurality of vertical extending substantially continuous studs, the reveal strip comprising:

(a) a first slot of elongate length and defined by three co-extensive sides, one of the sides terminating in a tapered edge adapted to extend over an outer surface of a wall covering member;

(b) a contiguously planar, single layer back plate integrally formed with one of said three co-extensive sides, the back plate defining an upper edge extending opposite the first slot, the back plate adapted to be substantially flush with one of the studs; and (c) a second slot;

(c) wherein said first slot is sized to mount on the edge of a wall covering member; and (d) said second slot faces opposite to said first slot to mount adjacent to the covering member and at an adjustable spacing from said first slot, the second slot including an upwardly extending tapered edge that is adapted to extend over an outer surface of the wall covering member, and the back plate being visible in the adjustable spacing between the slots.

20. An assembled wall construction for the exterior of a building frame, wherein the wall construction comprises:

(a) a first panel defining a first panel located edge and a first extreme outer surface;

(b) a second panel defining a second edge thereon and a second extreme outer surface;

(c) a contiguously planar, single layer back plate for fastening to the frame behind said first and second panels, the back plate defining an upper edge that is adapted to be substantially flush with the frame;

(d) a first slot for positioning along and reaching over the first edge of said first panel and over the extreme outer surface of the first panel; and (e) a second slot for clasping along and reaching over said second edge of said second panel and over the extreme outer surface of the second panel;

(f) wherein said first and second slots are adjustably positioned in front of said back plate, said first and second slots are parallel to define a sight visible area of said back plate between said first and second slots, said first and second panels are positioned with first edge and said second edge adjacent and horizontal along the wall, and said first and second slots have a length to receive said first and second edges of said first and second panels.

* * * * *